United States Patent [19]

Hetherington

[11] Patent Number: 4,700,428

[45] Date of Patent: Oct. 20, 1987

[54] HOSE ASSEMBLY FOR FLUID FLOW APPARATUS

[75] Inventor: Michael W. Hetherington, Ontario, Canada

[73] Assignee: Iona Appliances Inc./Appareils Iona Inc., Welland, Canada

[21] Appl. No.: 860,913

[22] Filed: May 8, 1986

[30] Foreign Application Priority Data

Dec. 2, 1985 [CA] Canada ..... 496686

[51] Int. Cl.[4] ..... A47L 5/32

[52] U.S. Cl. ..... 15/338

[58] Field of Search ..... 15/338, 332, 391; 474/144

[56] References Cited

U.S. PATENT DOCUMENTS

| | | | |
|---|---|---|---|
| 1,021,731 | 3/1912 | Spangler | 15/338 |
| 2,310,268 | 2/1943 | Taylor | 15/338 |
| 2,322,223 | 6/1943 | Coss | 15/332 |
| 2,871,504 | 2/1959 | Gall et al. | 15/338 |
| 2,996,748 | 8/1961 | Gitzendanner | 15/410 X |
| 3,955,237 | 5/1976 | Chateauneuf et al. | 15/338 X |
| 4,008,505 | 2/1977 | Clowers | 15/338 |

FOREIGN PATENT DOCUMENTS

| | | | |
|---|---|---|---|
| 519664 | 4/1940 | United Kingdom | 15/338 |

*Primary Examiner*—Chris K. Moore

*Attorney, Agent, or Firm*—Weldon F. Green

[57] ABSTRACT

In apparatus wherein a fluid flow path is defined within a housing and leads from an inlet in the housing to an outlet therefrom, a shell-like member having a first opening therein for establishing communication with a length of hose and a second opening remote from the first opening bounded by an edge formation, configured so as to surround the housing inlet when the second opening is brought into overlying registration with the inlet, and means carried by the housing and hose assembly respectively for releasably securing the shell-like member to the housing with the second shell opening presented in overlying registration to the housing inlet.

5 Claims, 6 Drawing Figures

FIG. 1a
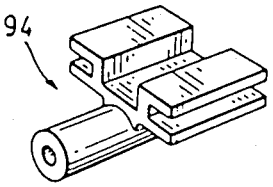
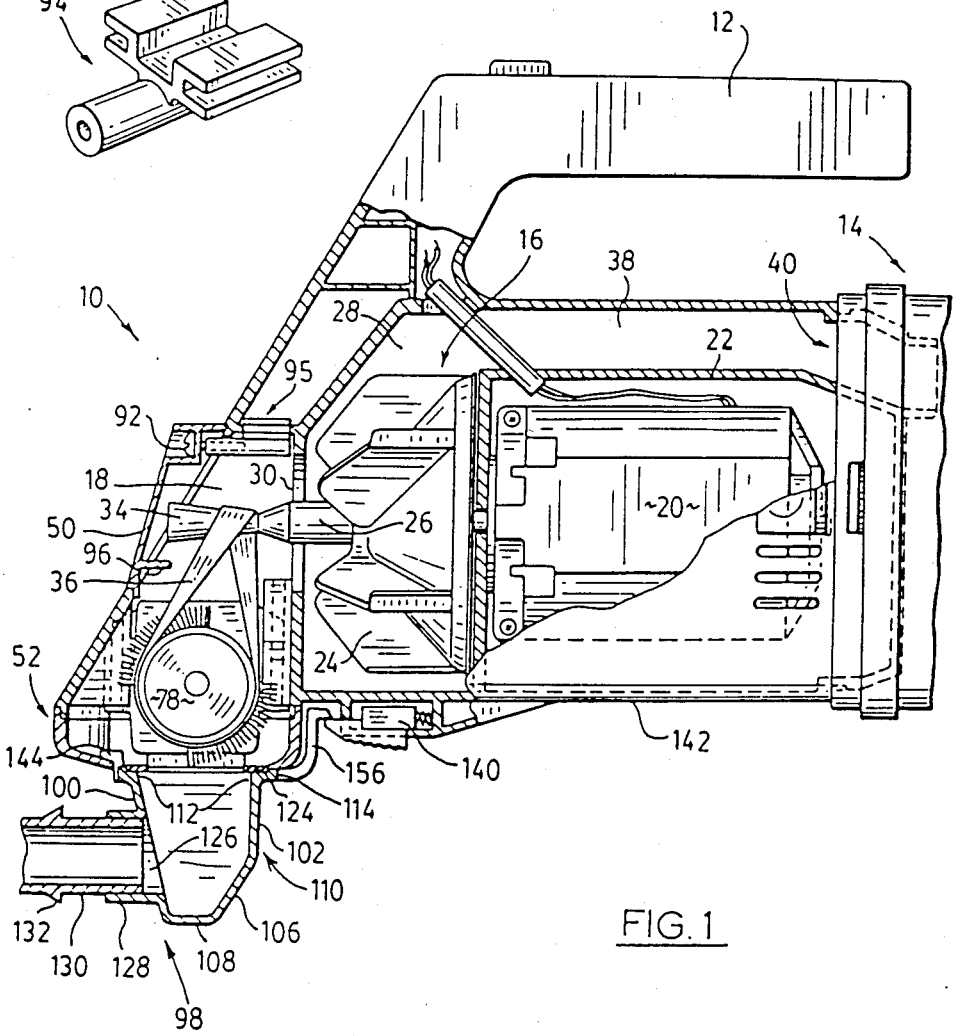
FIG. 1

FIG. 4
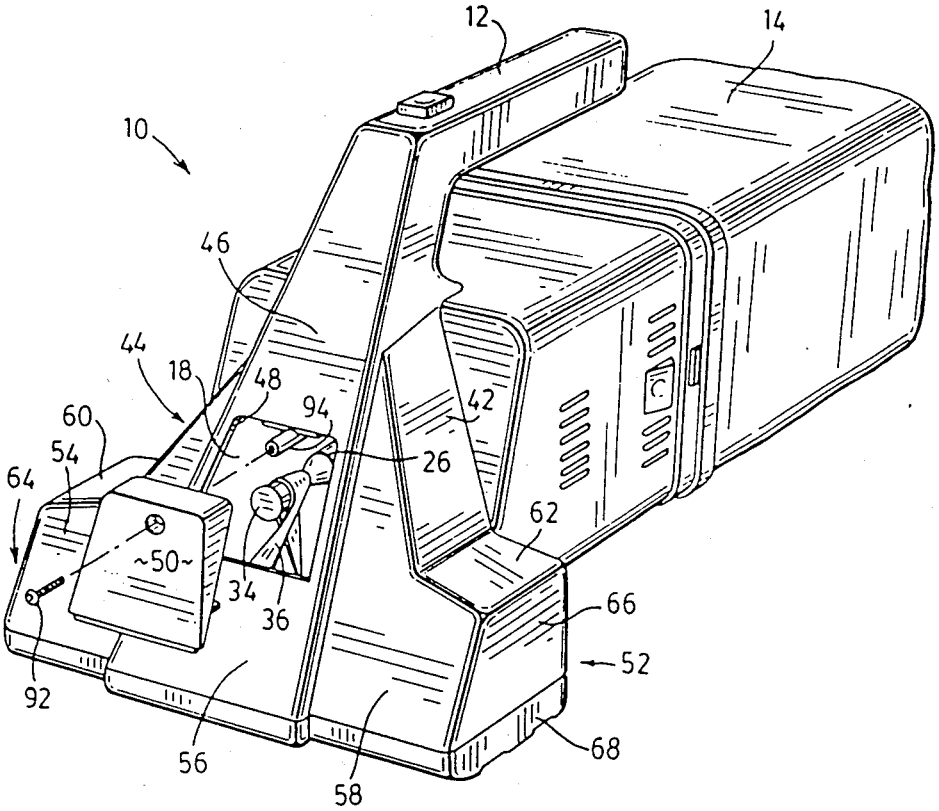
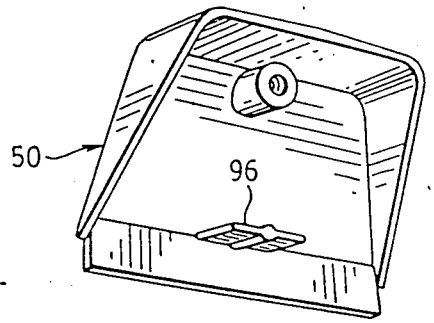
FIG. 5

HOSE ASSEMBLY FOR FLUID FLOW APPARATUS

FIELD OF THE INVENTION

This invention relates to improvements in suction or vacuum apparatus wherein a generally cylindrical brush or beater is mounted for rotation within the nozzle portion of the suction or vacuum apparatus take-up passageway and is adapted to be driven by the shaft of the suction fan motor through a tensioned belt connection.

More particularly, this invention relates to an improved coupling for releasably securing a hose element to such apparatus in a manner that ensures the requisite pressure drop over the extended flow path established by the attachment and without disengagement of the tensioned belt connection between the fan motor shaft and brush or beater.

BACKGROUND OF THE INVENTION

Suction or vacuum apparatus of the type that utilizes a generally cylindrically-shaped rotary brush or beater includes a mounting for same within a nozzle portion of the housing which extends longitudinally thereof and presents an elongated inlet therewithin lowermost through which the brush or beater partly projects for making appropriate contact with the floor surface or carpet so that brushing or beating action can be applied and any dirt or debris drawn into the housing inlet by the air stream created by the suction fan and conveyed through the take-up passageway to the suction fan and into the collection chamber.

The brush or beater is driven about its longitudinal axis by a suitably tensioned endless belt offset or twisted to form a first loop which frictionally engages the brush or beater generally centrally of the longitudinal extent thereof and a second loop which engages a suitably tapered unsupported end portion of the fan motor shaft which extends into the take up passageway.

Such apparatus is usually provided with a normally closed access opening in the casing forwardly of and in alignment with the unsupported end of the fan motor shaft so that the endless belt when it fails can be replaced or if it is disengaged can be re-engaged.

It is through such access opening that a hose coupling of the prior art is adapted to be connected to the intake of the suction fan which requires that the tensioned belt be removed or displaced as revealed by the following patents.

Dayton U.S. Pat. No. 2,616,115 discloses a hose coupling arrangement wherein the endless tensioned belt is completely removed from the fan motor shaft extension by means of a belt disengaging apparatus and is transferred to a sleeve which is axially aligned with the fan motor shaft and projects inwardly from a cover plate closing the access opening in the forward wall of the take-up passageway. The cover plate, associated sleeve and belt can then be swung forwardly and disposed below the access opening thereby allowing presentation of the hose coupling to the intake of the suction fan.

Alternatively, as in the case of Thornwald U.S. Pat. No. 2,708,766 a coupling arrangement is provided wherein the tensioned belt is displaced or distended out of normal alignment with the motor shaft pulley and transferred onto a fixed belt supporting abutment while simultaneously registering the coupling with the intake of the suction fan.

Another proposal is outlined in Stent Canadian Pat. No. 455,305. According to the latter patent, a tubular coupling assembly includes an inner tubular portion rotatably mounted within an outer tubular portion. The outer tubular portion is inserted through the opening in the forward wall of the take-up passageway and registers with the intake orifice of the blower or fan. The inner tubular portion is provided with a projection which enters between the opposed reaches of the drive belt which upon rotation displaces the belt upwardly and disengages same from the fan motor shaft extension.

The step of removing the closure and disengaging the belt from the motor shaft when the hose coupling is to be attached involves the provision of somewhat complex structures, which structures are subject to wear and consequent repair as well as further extension of the already tensioned belt leading to deterioration as well as considerable inconvenience in executing the changeover.

OBJECTS OF THE INVENTION

It is therefore the principal object of this invention to provide an improved hose coupling for such suction or vacuum apparatus which can be utilized without disengagement of the tensioned belt from the motor shaft or from the rotary brush or beater, yet establish a connection that is substantially airtight and wherein pressure drop losses over the length of the flow path defined by the hose and coupling are effectively minimized.

It is also an important object of this invention to provide a coupling of relatively simple structure and in relation to which attachment to the apparatus and release therefrom can be readily accomplished.

FEATURES OF THE INVENTION

The principal feature of this invention resides in providing, in apparatus wherein a fluid flow path is defined within a housing and leads from an inlet in said housing to an outlet therefrom, a hose assembly for extending the fluid flow path beyond the housing including a shell-like member having a first opening for establishing communication with a length of hose and a second opening remote from the first opening for overlying registration with the inlet. The second opening is bounded by an edge formation projecting outwardly around the opening. The edge formation has such an extent and configuration as to surround the inlet and bear against the housing when the second opening is presented in overlying registration to the inlet. Means are carried by the housing and the hose assembly respectively for releasably securing the shell-like member to the housing when the second opening is presented in overlying registration.

Another feature of the invention resides in providing in such or similar apparatus a hose assembly as described above wherein the shell-like member is adapted to enclose a revoluble brush which project partly through the apparatus inlet, such revoluble brush being mounted in the region of the inlet and being driven by a twisted tensioned endless belt connection to an unsupported end of a driven motor shaft.

A further feature of the invention resides in providing compressible gasket means extending outwardly from the edge formation of the hose assembly such that a sealing engagement may be achieved between the shell-like member and the housing when the second opening in the shell-like member is presented in overlying registration to the housing inlet. Thus any suction losses are effectively minimized.

Another feature of the invention resides in providing a hose assembly wherein the shell-like member has an elongated trough-like configuration so as to complement the elongated inlet of the housing through which revoluble means extending longitudinally of the inlet project partly and wherein the second opening is disposed uppermost in the shell-like member and extends longitudinally thereof. The first opening is located in an elongated wall portion of the shell-like member and intermediately of the longitudinal extent of same.

Another feature of this invention resides in providing such apparatus as described above wherein the elongated wall portion which includes the first opening extends at generally right angles to the plane of the second longitudinally extending opening so as to enable an effective forward presentation of the accessory attachments and hose lengths which are brought into communication with the first opening.

Another feature of the invention resides in providing positioning and latching means for apparatus described above which include at least a pair of spaced apart aligned hook-shaped projections upstanding from the portion of the edge formation which projects outwardly above the elongated wall portion, and wherein the housing includes spaced apart and aligned apertures adapted to receive the hook-shaped projections and to restrain the shell-like member against withdrawal only when the second opening in the shell-like member is presented in overlying registration with the inlet of the housing and also including cooperating means carried by the wall portion of the shell-like member opposed to the elongated wall portion and the housing respectively for releasably securing same against separation.

Finally, it is a feature of this invention to provide in such or similar apparatus which includes a revoluble brush mounted in the housing in the region inwardly of the housing inlet, said projecting partly therethrough as well as motor means including a driven shaft presenting an unsupported end of the driven shaft into the fluid flow path and further including endless tensioned belt means extending between the unsupported shaft end and the revoluble brush for rotating same, a removable barrier to the displacement imparted to the tensioned endless belt in the form of a bearing surface formation presented to at least one reach of the tensioned endless belt in the region of the unsupported end portion of the driven shaft and adjacent thereto, such bearing surface formation including an anchoring portion for releasably securing same to the surrounding housing and a portion projecting therefrom, the projecting portion including a bearing surface at the end thereof remote from the anchoring portion for contact with the endless belt in the aforementioned region should the belt creep from the position establishing the operating relationship of belt to driven shaft towards the unsupported end. Such creeping of the belt towards disengagement may be a result, for example, of inadvertent manipulation of the revoluble means while attaching the hose assembly.

BRIEF DESCRIPTION OF THE DRAWINGS

These and other objects and features are to be found in the following description of the preferred embodiment of the invention to be read in conjunction with the sheets of drawings in which:

FIG. 1 is a sectioned side view of portable suction or vacuum apparatus including closure member and bearing surface formation according to the invention;

FIG. 1*a* is an enlarged perspective view of a socket element for use in conjunction with the apparatus of FIG. 1;

FIG. 4 is a perspective front view of the apparatus of FIG. 1 but not including the hose assembly wherein the closure member is exploded away in order to illustrate its relationship with the front wall of the apparatus;

FIG. 5 is an enlarged perspective rear view of the closure member and bearing surface formation of FIGS. 1, 2, 3 and 4 according to the invention.

DETAILED DESCRIPTION OF THE PREFERRED EMBODIMENT

Figure 3:
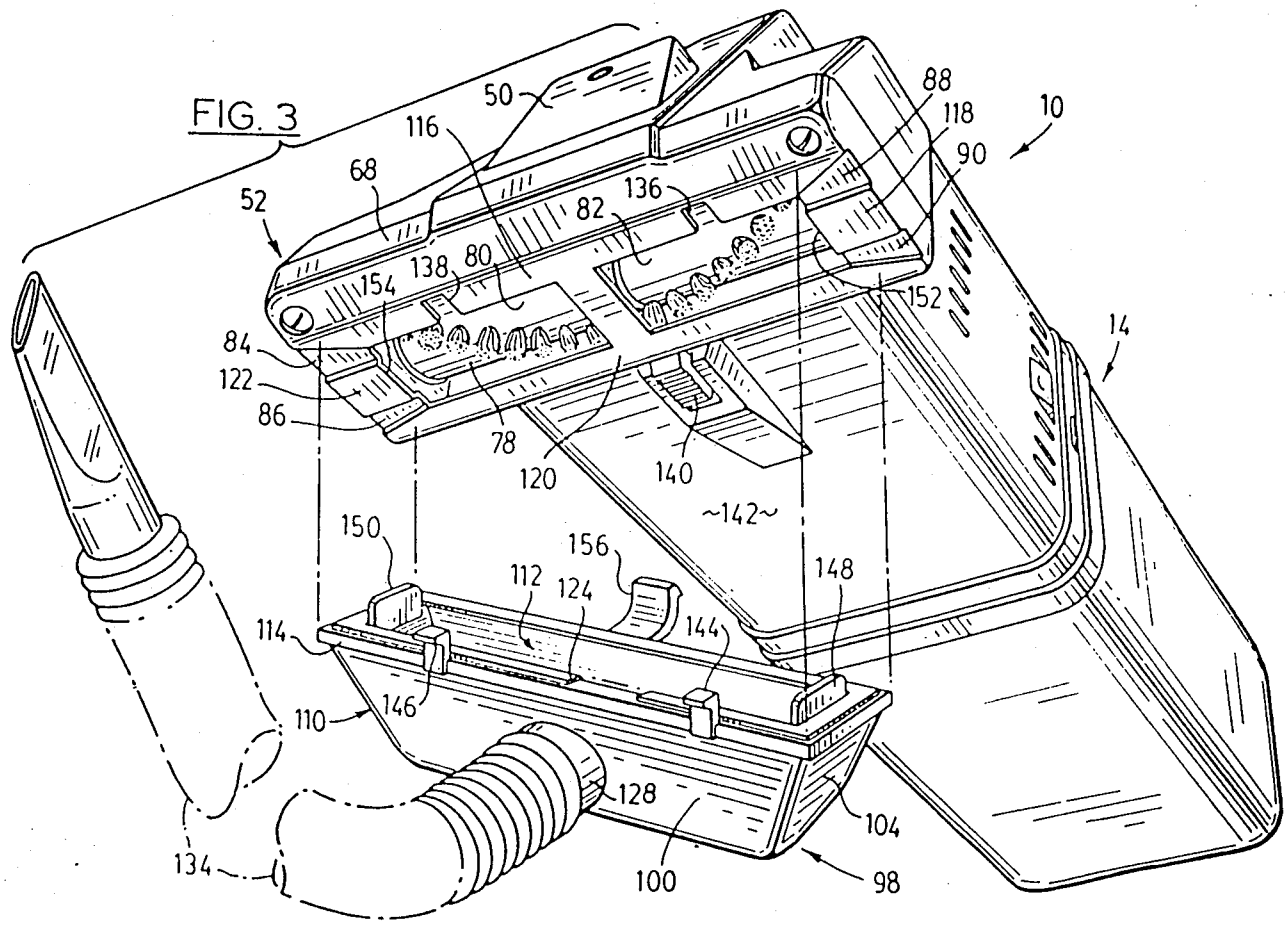
FIG. 3 is a perspective bottom view of the apparatus of FIG. 1 wherein the relationship between the hose assembly and the nozzle is illustrated.

According to the preferred embodiment of the invention, portable vacuum apparatus generally designated at 10 in FIG. 1 includes a handle 12, a filter and dirt collection unit 14, only partially shown in FIG. 1 but more fully illustrated in FIG. 3, a fan or blower unit 16 and a take-up passageway 18.

The fan or blower unit 16 includes a motor 20 mounted within motor housing 22, and impellor 24 driven by motor shaft 26 within impellor chamber 28.

Motor shaft 26 extends forwardly of the motor housing 22 through orifice 30 of impellor chamber 28 and into the take up passageway 18. The unsupported end 34 of motor shaft 26 is suitably tapered so as to form a pulley groove for a endless tensioned belt 36 as described in greater detail below.

In operation, motor 20 drives impellor 24 which draws air from take up passageway 18 through orifice 30 and into impellor chamber 28. The air is then directed through evacuation channel 38 and outlet 40 to the filter and dirt collection unit 14.

The take up passageway 18 is defined by a surrounding housing best illustrated in FIG. 4 which includes forwardly and downwardly diverging side walls 42 and 44 and a forwardly and downwardly extending forward wall 46. Forward wall 46 includes an access opening 48 and a closure member 50 as described in greater detail below.

The housing surrounding and defining the take up passageway 18 further includes an enlarged base portion lowermost thereof, hereinafter referred to as the nozzle 52. Said nozzle is defined by forwardly inclined front wall portions 54, 56 and 58, generally laterally extending segments 60 and 62, substantially parallel side walls portions 64 and 66 and a base plate 68, best illustrated in FIG. 3.

Figure 2:
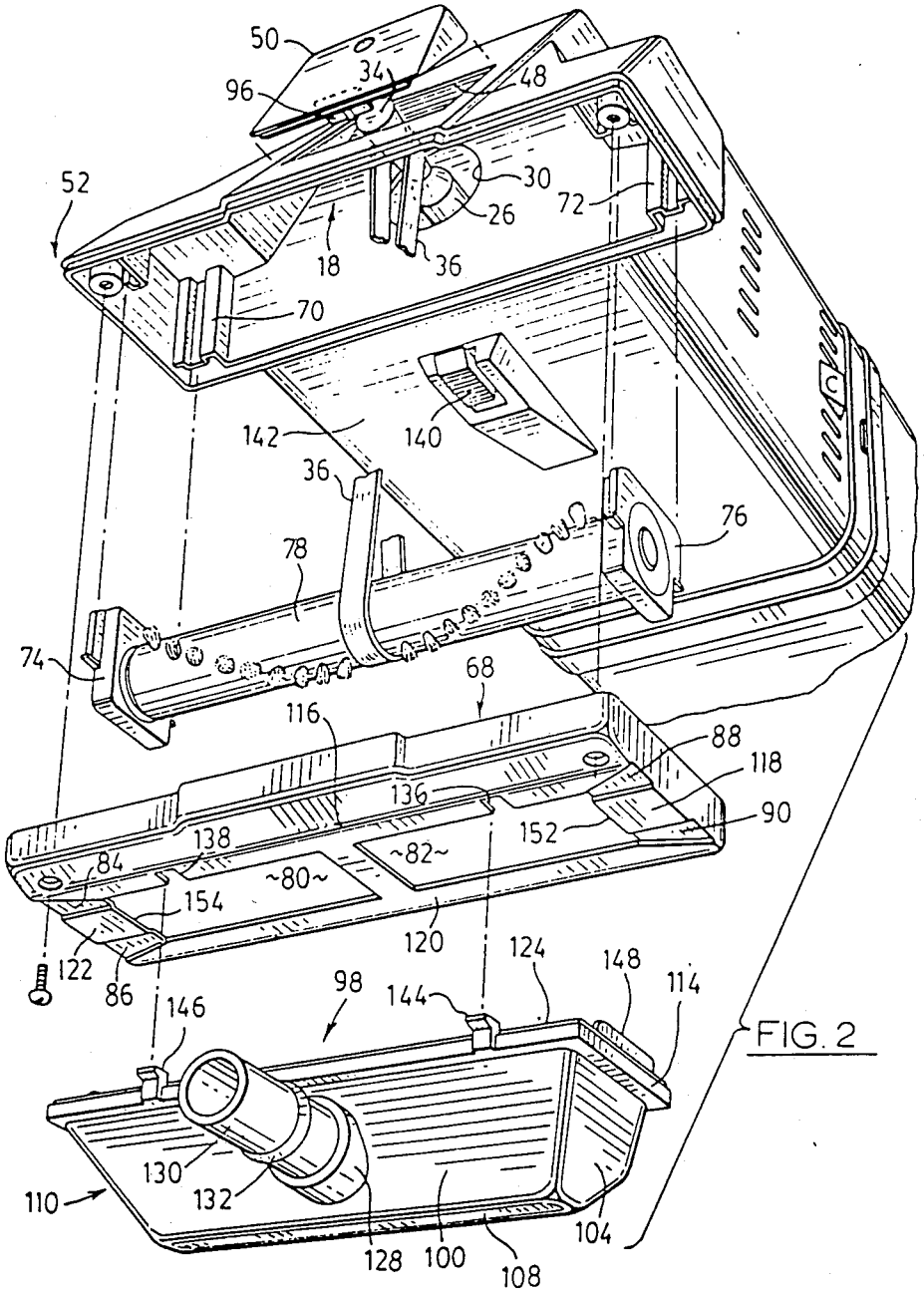
FIG. 2 is an exploded view of the nozzle, brush and brush mountings and hose assembly.

Referring to FIG. 2, sockets 70 and 72 are provided in the nozzle 52 and are adapted to receive mountings 74, 76 for a rotary brush 78 to extend longitudinally within the nozzle.

Base plate 68 of nozzle 52 partially encloses the take up passageway 18, as best illustrated in FIG. 3, but includes inlet orifices 80, 82 through which rotary brush 78 partly projects so as to allow the rotary brush to come into contact with the surface to be cleaned. Base plate 68 also includes vents 84, 86, 88 and 90 at the longitudinal extremities thereof so as to enable the nozzle to effectively clean wall corners and other angled locations by providing a passageway for entraining air and dirt particles from such corners or angled locations when the corner of the cleaner nozzle 52 is seated therein.

Referring to FIG. 1, the rotary brush 78 is driven to rotate about its longitudinal axis by a suitably tensioned endless belt 36 offset by twisting to form a lower loop which frictionally engages rotary brush 78 centrally of the longitudinal axis thereof and generally at right angles thereto and an upper loop which engages the unsupported end 34 of the driven motor shaft 26 which extends into the take up passageway 18.

The access opening 48 is provided in the forward wall 46 of the housing which defines the take up passageway opposed to and in general alignment with the unsupported shaft end 34 and a closure member 50 adapted to register within access opening 48 as best illustrated in FIGS. 2 and 3. The outer shape of closure member 50 may be chosen to complement the aesthetic presentation of the exterior of the take up passageway housing and to provide a convenient grip for removal of the closure member.

The closure member 50 may be detachably secured over access opening 48 by means of a screw 92. A suitable socket element 94 illustrated in FIG. 1*a* is secured in the upper end of the take up passageway 18 as at 95, as best illustrated in FIG. 1, and is adapted to receive screw 92.

A substantially horizontal inwardly projecting flange 96 is anchored upon closure member 50 and is adapted to nearly abut the downwardly extending reach of the endless tensioned belt 36 when closure member 50 is secured over access opening 48 by screw 92 as best illustrated in FIG. 1. Flange 96 acts as a bearing surface formation barring advancement of the endless tensioned belt along a path towards the unsupported end 34 of the driven motor shaft and the belt 34 is therefore effectively prevented from becoming disengaged from the motor shaft 26 when the rotary brush is inadvertently forced into rotation in a direction opposite to that of its normal operational rotation. Removal of closure member 50 removes flange 96 from its nearly abutting relationship with the edge of tensioned endless belt 36 so as to allow removal, inspection and repair of belt 36 while simultaneously allowing access thereto through access opening 48.

Referring to FIGS. 1, 2 and 3, a hose assembly generally designated 98 includes generally upstanding front 100, back 102, side 104 wall portions, an inclined back wall portion 106 and a base portion 108 defining a narrow and elongated trough-like structure 110. The upper edges of the said wall portions define an opening 112 into the trough-like structure, said upper edges of said wall portions terminating in an outwardly projecting edge formation 114 surrounding said opening. The narrow and elongated trough-like structure 110 is of such an extent and configuration that when opening 112 is presented in overlying registration with the base plate 68 of the nozzle 52 the edge formation bears against the surface segments 116, 118, 120 and 122 of the base plate 68 surrounding the generally elongated inlet orifices 80 and 82 and the trough-like structure encloses the rotary brush 78. Edge formation 114 includes a peripheral strip of compressible gasket means 124 carried thereon so as to provide an airtight seal when the trough-like structure 110 and the base plate 68 are brought into overlying registration.

The elongated front wall portion 100 of the trough-like structure 110 includes an opening 126 bounded by a first tubular portion 128 and located intermediately of the longitudinal extent of the front wall portion 100. A second tubular portion 130 of a diameter slightly smaller than that of the first tubular portion 128 is fixed within said first tubular portion 128. The second tubular portion 130 includes a peripheral barb 132 so that a suitable length of hose 134 may be engaged over the barb 132 and onto the second tubular portion 130. Crevice cleaners, dusting tools or other accessories may be detachably secured to said length of hose as required in particular cleaning applications.

Attachment of the hose assembly 98 to the nozzle 52 is as follows:

The base plate 68 of the nozzle 52 includes two forwardly disposed and spaced apart apertures 136, 138 and one spring loaded keeper or plunger 140 located centrally of the underside of the cleaner housing 142 and rearwardly of the base plate 68. The front wall portion 100 of the trough-like structure 110 includes two aligned and spaced apart hook-shaped projections 144 and 146 upstanding from the edge formation and complementary to the apertures 136 and 138 in the base plate such that when the hook-shaped projections 144 and 146 are brought into registration with the apertures 136 and 138 a swivelling relationship is established between such projections and such apertures such that the hose assembly 98 may be swivelled rearwardly over the base plate 68. Locating ribs 148, 150 extending upwardly from side wall portions 104 are adapted to engage the edges 152, 154 of the inlet orifices 80, 82 respectively so as to position the hose assembly for airtight sealing engagement over said inlet orifices when same is brought into overlying registration with the base plate 68. The back wall portion 102 of the trough-like structure 110 includes an arm 156 extending rearwardly and centrally of the back wall portion 102 of the trough-like structure 110, said arm being adapted to be brought into registration and to cooperate with the spring loaded keeper or plunger 140 when the hose assembly is swivelled onto the base plate so as to releasably secure same to said base plate.

Thus the hose assembly can be easily connected by holding the vacuum apparatus in one hand by handle 12 and supporting and directing the trough-like structure 110 with the other to connect hook-shaped projections 144 and 146 into apertures 136 and 138 respectively. The trough-like structure is then pivoted rearwardly until arm 156 latches into spring-loaded plunger 140 by acting upon the forward levelled portion of said plunger to depress the plunger spring and displace the plunger rearwardly.

What I claim is:

1. In apparatus wherein a fluid flow path is defined within a housing and leads from an inlet in said housing to an outlet therefrom, a hose assembly for extending the fluid flow path in said housing therebeyond including an elongated trough-like member having a side opening therein for establishing communication with a length of hose and a top opening therein remote from said side opening for overlying registration with said inlet and bounded by an edge formation projecting outwardly therearound, said edge formation having an extent and configuration to surround said inlet and bear against said housing when said top opening is presented in overlying registration thereto and means carried by said housing and said hose assembly resepectively for releasably securing said elongated trough-like member to said housing when said top opening therein is presented in overlying registration to said inlet of said housing, said means comprising a pair of spaced apart aligned hook-shaped projections upstanding from a portion of said edge formation and projecting outwardly thereabove on one side of said elongated trough-like member and means in said housing adjacent said inlet of a configuration and alignment for releasably receiving and holding said hook-shaped projections in pivoting engagement therewith and constraining same against withdrawal when said top opening is presented in overlying registration to said inlet, and an arm portion projecting outwardly from said trough-like member on the side thereof opposite said hook-shaped projections for releasably engaging with latch means carried by said housing.

2. In suction apparatus wherein a fluid flow path is defined within a housing and leads from an inlet in said housing to an outlet therefrom, said apparatus including a revoluble brush mounted within said housing for rotation in the region inwardly of said inlet and projecting partly therethrough, motor means including a driven shaft carried by said housing and presenting an unsupported end of said driven shaft into said fluid flow path inwardly of said revoluble brush, endless tensioned belt means extending between said unsupported shaft end and said revoluble brush for rotating same, a hose assembly for extending the fluid flow path therebeyond said housing including an elongated trough-like member having a side opening therein for establishing communication with a length of hose and a top opening therein remote from said side opening for overlying registration with said inlet and bounded by an edge formation projecting outwardly therearound, said trough-like member having an extent and configuration such that when said second opening of said trough-like member is presented in overlying registration to said inlet said edge formation bears against said housing in the region thereof surrounding said inlet and encloses said revoluble brush therewithin and in spaced relation thereto and means carried by said housing and said hose assembly respectively for releasably securing said trough-like member to said housing when said top opening therein is presented in overlying registration to said inlet of said housing, said means comprising a pair of spaced apart aligned hook-shaped projections upstanding from a portion of said edge formation and projecting outwardly thereabove on one side of said trough-like member and means in said housing adjacent said inlet of a configuration and alignment for receiving and holding said hook-shaped projections in pivoting engagement therewith and constraining same against withdrawal when said top opening is presented in overlying registration to said inlet, and an arm portion projecting outwardly from said trough-like member on the side thereof opposite said hook-shaped projections for releasably engaging with latch means carried by said housing.

3. An apparatus according to claim 2 wherein a base plate is positioned at said inlet, said base plate having a central orifice defining the entrance of said inlet and having a vent on at least one side defining a passageway from said side into said central orifice and wherein the edge formation on said trough-like member has an upright projection for closing said passageway when the hose assembly is in overlying registration with said housing.

4. An apparatus according to claim 3 wherein said base plate has an elongated configuration defined by elongated front and back walls and a pair of side walls, the base plate having an elongated central orifice defined therein and said trough-like member having an elongated configuration defined by elongated front and back walls and a pair of side walls with an edge formation projecting outwardly therearound to define said top opening, said base plate including at least one vent on each of said walls each said vent defining a passageway from said side wall to said central opening, and an upright projection on each said side wall of said trough-like member for engaging the interior side walls of the base plate and closing the passageway between the vents and the central opening when the hose assembly is secured in overlying registration with said housing.

5. Apparatus according to any one of claims 1, 2, 3 or 4 wherein said edge formation includes compressible gasket means projecting outwardly therefrom whereby sealing engagement is established between said trough-like member and said housing when said top opening therein is presented in overlying registration to said inlet of said housing.

* * * * *